United States Patent [19]

Mabee et al.

[11] Patent Number: 4,883,037

[45] Date of Patent: Nov. 28, 1989

[54] THROTTLE CONTROL SYSTEM

[75] Inventors: Brian D. Mabee, Warren; Keith V. Leigh-Monstevens, Troy, both of Mich.

[73] Assignee: Automotive Products plc, Warwickshire, England

[21] Appl. No.: 214,751

[22] Filed: Jul. 5, 1988

Related U.S. Application Data

[63] Continuation-in-part of Ser. No. 156,850, Feb. 17, 1988.

[51] Int. Cl.[4] ..... F02D 41/10

[52] U.S. Cl. ..... 123/399; 192/0.052; 192/0.033; 180/179

[58] Field of Search ..... 123/399, 361, 403; 192/0.052, 0.033, 0.076, 3.58; 180/179; 74/866; 310/156

[56] References Cited

U.S. PATENT DOCUMENTS

| | | | |
|---|---|---|---|
| 4,413,714 | 11/1983 | Windsor | 192/0.033 |
| 4,418,810 | 12/1983 | Windsor | 192/0.076 |
| 4,432,445 | 2/1984 | Windsor | 192/0.076 |
| 4,497,397 | 2/1985 | Windsor et al. | 192/0.076 |
| 4,518,064 | 5/1985 | Windsor | 192/3.58 |
| 4,561,530 | 12/1985 | Parsons et al. | 192/0.076 |
| 4,638,898 | 1/1987 | Braun | 192/0.052 |
| 4,677,880 | 7/1987 | Hattori et al. | 74/866 |
| 4,698,535 | 10/1987 | Shiraki et al. | 310/156 |
| 4,727,838 | 3/1988 | Oshiage et al. | 123/399 |
| 4,729,356 | 3/1988 | Kaneko et al. | 123/399 |
| 4,773,370 | 9/1988 | Koshizawa et al. | 123/399 |
| 4,787,353 | 11/1988 | Ishikawa et al. | 123/399 |

FOREIGN PATENT DOCUMENTS

| | | |
|---|---|---|
| 0114404 | 1/1984 | European Pat. Off. . |
| 1202822 | 8/1970 | United Kingdom . |
| 1258430 | 12/1971 | United Kingdom . |
| 1460011 | 12/1976 | United Kingdom . |

OTHER PUBLICATIONS

SAE Technical Paper #860477/Robert G. Sokalski et al., Feb. 1986.

SAE Technical Paper #850173/Michael E. Moncelle et al., Feb. 1985.

SAE Technical Paper #840448/Manfred Schwab et al., Feb. 1984.

SAE Technical Paper #880407/Roger F. Wells et al., Feb. 1988.

Ledex Catalog #SS-1104, Jul. 1975.

Automotive Engineer, Aug. 1987.

Automotive Products Catalog, Aug. 1987.

*Primary Examiner*—Raymond A. Nelli

*Attorney, Agent, or Firm*—Krass & Young

[57] ABSTRACT

A throttle control system including position sensing means to track the instantaneous position of the accelerator pedal, position sensing means to track the instantaneous position of the throttle valve, and a control module operative to compare the accelerator pedal and throttle valve position signals and generate a control signal for delivery to an actuator to position the throttle valve in response to the position called for by the accelerator pedal.

39 Claims, 4 Drawing Sheets

FIG. 2
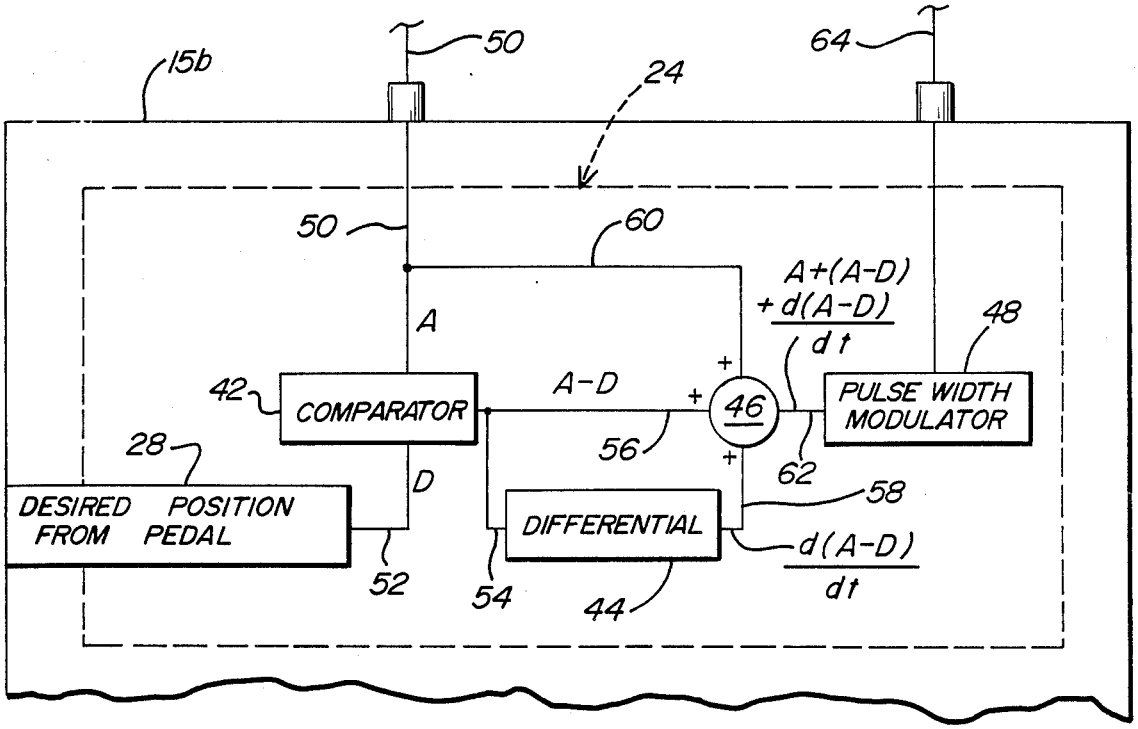
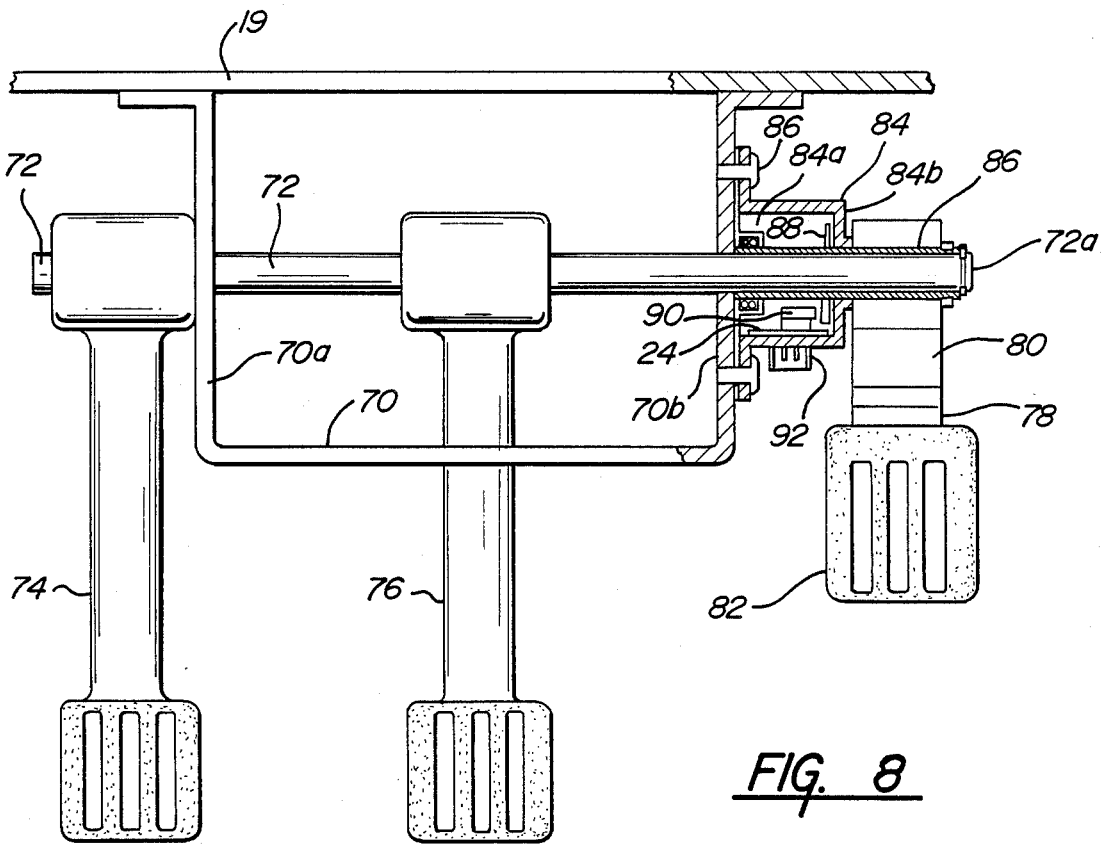
FIG. 8

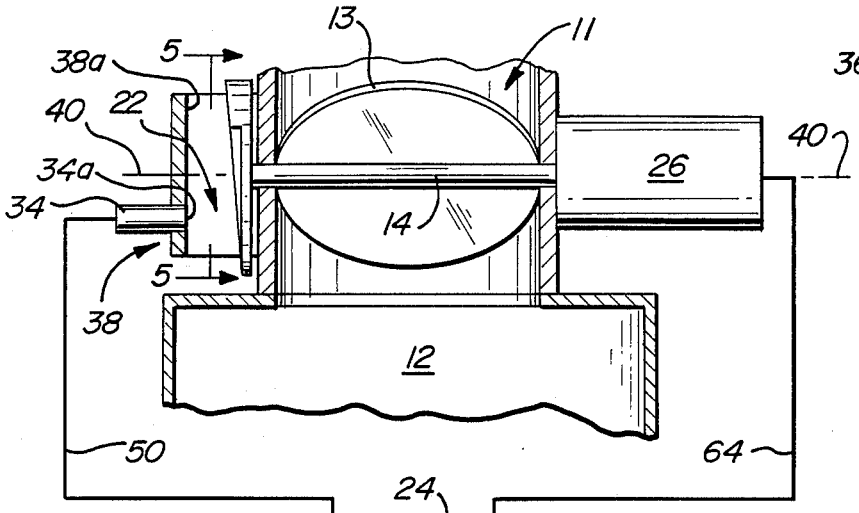
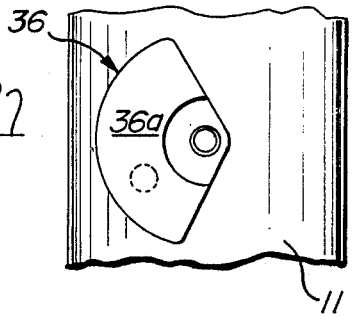
FIG. 5
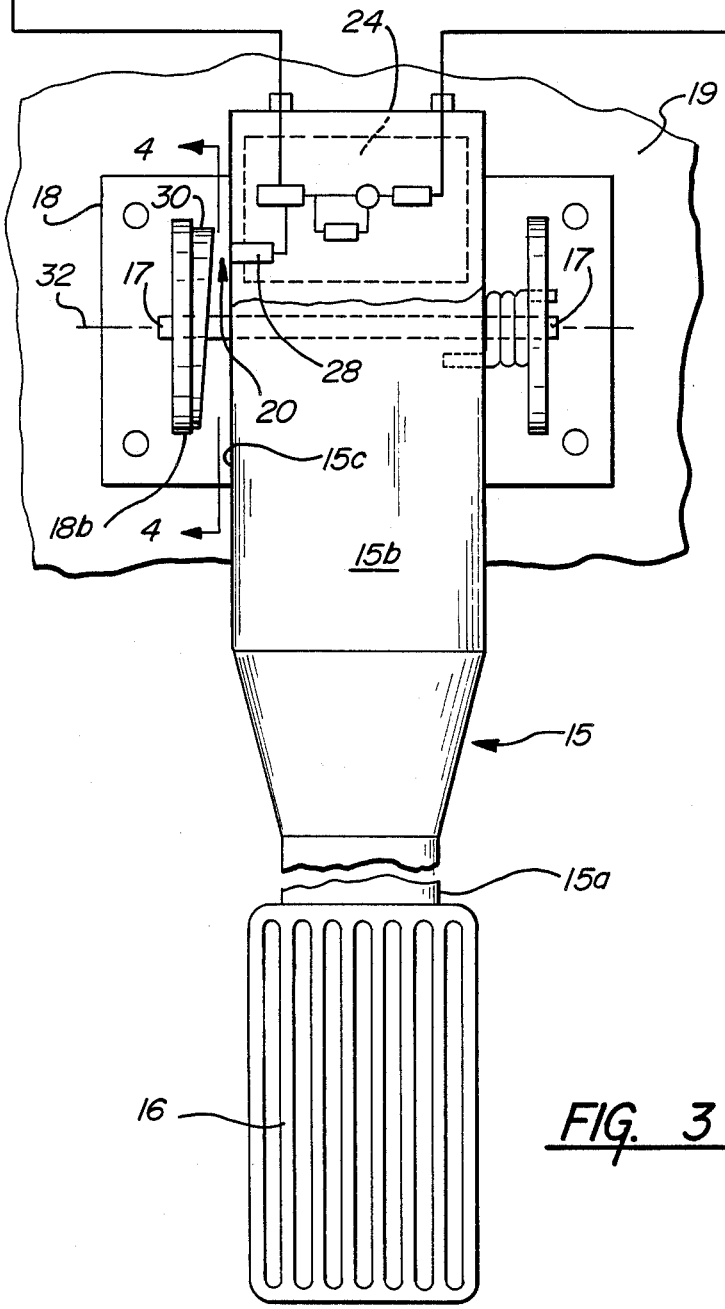
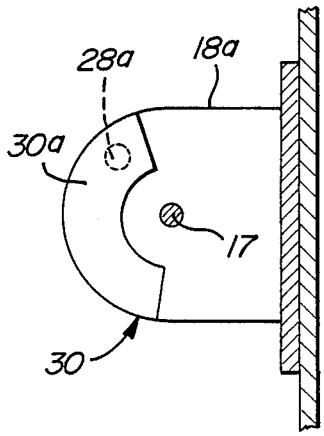
FIG. 4
FIG. 3

THROTTLE CONTROL SYSTEM

REFERENCE TO RELATED APPLICATION

This application is a continuation-in-part of U.S. patent application Ser. No. 156,850 filed on Feb. 17, 1988.

BACKGROUND OF THE INVENTION

This invention relates to throttle control systems for motor vehicles and more particularly to an electronic throttle control system.

Conventionally, throttle control systems for motor vehicles have consisted of a throttle pedal connected to a cable which in turn is connected to the throttle body of the engine so as to control the throttle valve mounted within the throttle body and thereby control the delivery of the fuel/air mixture to the engine. Whereas cable controlled throttle control systems are generally satisfactory and have seen widespread application, they present problems in the context of the increasingly crowded underhood environment of a modern day motor vehicle. Specifically, the cables must be circuitously routed from the accelerator pedal to the throttle body and the resulting circuitous configuration of the cable creates large amounts of friction within the cable assembly and thereby renders the cable assembly relatively inefficient. The prior art cable systems have also often failed to provide the required sensitivity as between movement of the throttle pedal and the desired movement of the throttle valve of the throttle body.

In an effort to avoid the disadvantages of the cable controlled systems, electronic systems have been developed to transmit the signal from the accelerator pedal to the throttle valve. However, the prior art electronic control systems have failed to provide a smooth control signal but rather have provided an oscillating control signal which has had the effect of inducing shock loading and damage to the transmission and other drivetrain components.

SUMMARY OF THE INVENTION

This invention is directed to the provision of an improved throttle control system for a motor vehicle.

More specifically, this invention is directed to the provision of an electronic throttle control system for a motor vehicle in which the control system provides an extremely fast response as between the accelerator pedal and the throttle valve and in which the control signal is smooth so as to avoid undue loading to the drivetrain component.

This invention is further directed to the provision of an electronic throttle control system possessing extreme durability and reliability.

This invention is further directed to the provision of a modular accelerator pedal assembly incorporating means for generating a control signal for transmittal to the throttle valve.

The throttle control system of the invention is intended for use with a motor vehicle of the type including an engine, a throttle body including a throttle valve control member, an operator actuated accelerator control member, throttle valve member position sensing means operative to generate a first electrical signal representing the position of the throttle valve member, accelerator member position sensing means operative to generate a second electrical signal representing the position of the accelerator member, control means receiving the first and second signals and operative to generate a control signal based on a comparison of the first and second signals, and actuator means receiving the control signal and operative to position the throttle valve member in proportion to the control signal. According to the invention, at least one of the position sensing means comprises a proximity sensor device and a target device and the proximity sensor device and the target device are moved relative to each other in response to movement of the associated control member. This arrangement retains all of the inherent advantages of an electronic throttle control system while minimizing wear of the position sensing assembly so as to maximize durability of the system.

The throttle valve member position sensing means may comprise a proximity sensor assembly; the accelerator member position sensing means may comprise a proximity sensor assembly; or, preferably, both sensing means may comprise proximity sensor arrangements so as to minimize wear of the sensing means both with respect to the throttle valve position sensing means and with respect to the accelerator position sensing means.

According to a further feature of the invention, the control member, whether the throttle valve control member or the accelerator control member, is mounted for adjusting movement about a pivot axis and the target device presents an arcuate target surface to the proximity sensor device that is centered on the pivot axis and that progressively varies in distance from the proximity sensor in response to pivotal adjusting movement of the associated control member about the pivot axis. This arrangement provides a simple and inexpensive means of generating a sensor voltage output that varies in proportion to the angular position of the associated control member.

In one embodiment of the invention, the target device or the throttle valve member position sensing means is mounted on an associated bracket structure and the proximity sensor is mounted on the upper end of the pedal arm of the accelerator assembly, and in another embodiment of the invention the proximity sensor is mounted on the bracket structure and the target device is mounted for movement with the pedal arm of the accelerator assembly.

According to a further feature of the invention, the target surface presented by the target surface has a spiral disposition relative to the pivot axis so as to move progressively nearer to or further away from the proximity sensor in response to relative pivotal movement between the proximity sensor and the target device about the pivot axis. This arrangement provides a simple and inexpensive means of generating a precise voltage output accurately representing the angular position of the associated control member.

According to a further feature of the invention, the throttle control system further includes a logic module arranged to receive the first electrical control signal from the throttle valve member position sensing means and the second electrical control signal from the proximity sensor of the accelerator member position sensing means, and the logic module is integrated with the proximity sensor of the accelerator member position sensing means and mounted adjacent the pivot axis of the pedal arm of the throttle member assembly. In one embodiment of the invention, the proximity sensor and the associated logic module are mounted on the upper end of the pedal arm of the accelerator assembly and in another embodiment of the invention the proximity sensor and logic module are mounted on the bracket pivotally supporting the upper end of the pedal arm of the accelerator assembly.

According to a further aspect of the invention, an accelerator control assembly is provided comprising a bracket member; an accelerator pedal assembly including a pedal arm member pivotally mounted adjacent its upper end on the bracket member and a pedal pad on the lower end of the pedal arm; and a pedal position sensing means including a proximity sensor device and a target device. One of the devices is mounted on the bracket member and the other device is mounted for movement with the pedal arm so that the devices undergo relative movement in response to pivotal movement of the pedal arm to generate a control signal that varies in proportion to the angular position of the pedal arm. This modular accelerator control assembly may be readily installed in a motor vehicle to provide the accelerator pedal structure for the vehicle and simultaneously provide a means of generating a control signal for transmission to the throttle body of the vehicle representing the instantaneous angular position of the accelerator pedal.

According to a further feature of the invention, the accelerator control assembly further includes a logic module receiving the output signal from the position sensing device of the accelerator pedal assembly as well as the output signal from the throttle valve position sensing means, the logic module is operative to generate a control signal as a function of the received signals, and the logic module is mounted on the accelerator pedal assembly adjacent the upper end of the pedal arm. In one embodiment of the invention, the logic module is mounted on the upper end of the pedal arm and in another embodiment of the invention the logic module is mounted on the bracket structure pivotally mounting the upper end of the pedal arm.

According to a further feature of the invention, the control signal transmitted to the throttle actuator reflects the rate of change of the difference between the signals being received from the throttle valve member position sensing means and from the accelerator member position sensing means. This arrangement, whereby the throttle valve actuator responds to a control signal which reflects the rate of change of the difference between the throttle valve position signal and the accelerator pedal position signal, eliminates the problems with the prior art electronic control systems and, specifically, provides a control signal for the throttle valve actuator which is essentially without oscillations and which allows smooth and extremely fast response as between the throttle pedal and the throttle valve.

BRIEF DESCRIPTION OF THE DRAWINGS

FIG. 2 is a detailed view of a logic module employed in the throttle control system of FIG. 1;

FIG. 3 is an elevational, somewhat schematic, fragmentary view of the invention throttle control system;

FIGS. 4 and 5 are cross-sectional views taken respectively on lines 4—4 and 5—5 of FIG. 3;

FIG. 8 is a somewhat schematic view of an alternate form of throttle control system according to the invention.

DETAILED DESCRIPTION OF THE PREFERRED EMBODIMENTS

Figure 1:
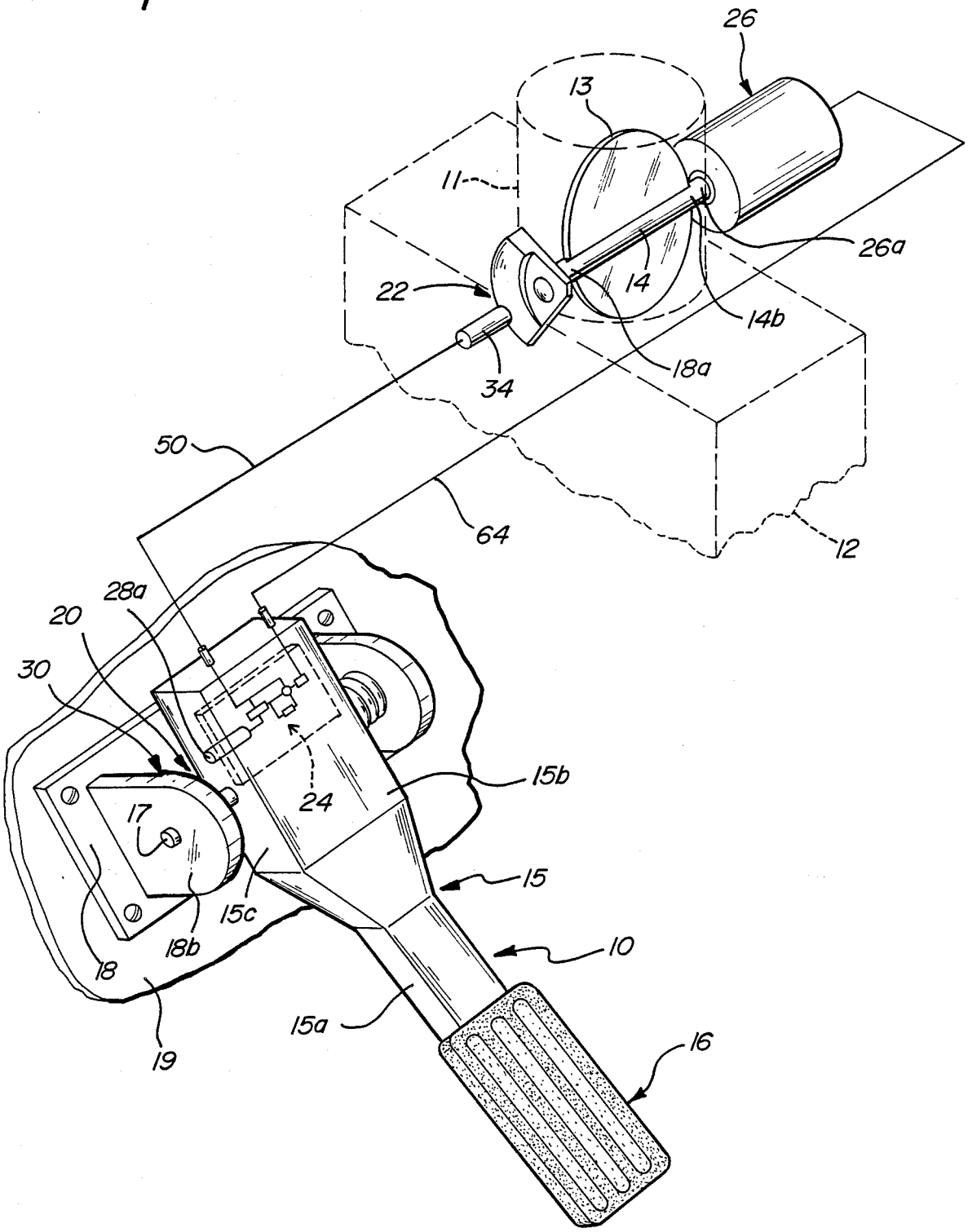
FIG. 1 is a perspective, somewhat schematic view of the throttle control system according to the invention.

The invention throttle control system of FIGS. 1–5 is intended for use with a motor vehicle of the type including an operator controlled accelerator or throttle pedal assembly 10, a throttle body 11 associated with an engine 12, and a throttle valve 13 mounted within throttle body Il for pivotal movement about a pivot shaft 14 so as to selectively control the delivery of air and/or fuel to the engine 12 in known manner.

Accelerator pedal assembly 10 includes a plastic pedal arm 15 and an elastomeric pedal pad 16 mounted on the lower end **15*a* of the pedal arm. The upper end 15*b* of the pedal arm is pivotally mounted by a pivot pin 17 on a bracket 18 suitably secured to the firewall 19** of the motor vehicle.

The invention throttle control system, broadly considered, includes an accelerator pedal position sensing means 20; a throttle valve position sensing means 22; a control logic module 24; and a throttle valve actuator 26.

Accelerator pedal position sensing means 20 includes a proximity sensor 28 and a target device 30. Proximity sensor 28 is preferably a Hall effect sensor and may for example be of the type available from Magnetic Sensors Corporation of Anaheim, Calif. as Part No.414-001. Hall effect sensor 28 is embedded or potted in the upper end **15*b* of plastic pedal arm 15 with the magnetically radiating face 28*a* thereof generally flush with a side face 15*c* of the pedal arm. Target device 30 is formed of a ferrous material and is the form of an arcuate plate secured to the inboard face of an ear 18*b* of bracket 18**.

Target plate 30 presents an arcuate target surface **30*a* to sensor 28 that is centered on the axis 32 of pivot pin 17 and progressively varies in distance from the confronting face 28*a* of sensor 28 in response to pivotal movement of pedal arm 15 about axis 32. Specifically, sensor 28 is located a radial distance from axis 32 corresponding to the mean radius of target surface 30*a* and target surface 30*a* has a spiraled disposition relative to axis 32 so that, as pedal arm 15 is pivoted about axis 32, sensor 28 moves in an arc corresponding to the arc of surface 30*a* and the distance between sensor face 28*a* and target surface 30*a* progressively varies due to the spiral disposition of target surface 28*a* relative to axis 32. Surface 28*a* thus continually tracks the angular position of pedal arm 15 so that sensor 28** continuously generates an electrical output signal that is proportional to the angular position of the pedal arm.

Throttle position sensing means 22 includes a proximity sensor 34 and a target device 36. Proximity sensor 34 is preferably a Hall effect sensor and may be of the same type as Hall effect sensor 28. Sensor 34 is mounted on a bracket 38 suitably secured to throttle body 11 with the magnetically radiating face **34*a* of the sensor generally flush with the inboard face 38*a* of bracket 38**.

Target 36 comprises an arcuate plate formed of ferrous material and fixedly secured to an end of throttle pivot shaft 14 exteriorly of throttle body 11. Target 36 presents an arcuate target surface **36*a* to sensor 34 that is centered on the axis 40 of pivot shaft 14 and progressively varies in distance from the confronting face 34*a* of sensor 34 in response to pivotal movement of throttle valve 13 about axis 40. Specifically, sensor 34 is located at a radial distance from axis 40 corresponding to the mean radius of target surface 36a and target surface 36a has a spiral disposition relative to axis 40 so that, as throttle valve 13 is pivoted about axis 40, target surface 36a moves in an arc centered on axis 40 and the distance between sensor face 34a and target surface 36a progressively varies due to the spiral disposition of target surface 34a relative to axis 40. Sensor 34 thus continuously tracks the angular position of throttle valve 13 so as to continuously generate an electrical output signal that is proportional the angular position of throttle valve 13**.

Control logic module 24 is in the form of a circuit or logic board embedded or potted in the upper end 15b of plastic pedal arm 15 and integrated with Hall effect sensor 28. Module 24 includes a comparator 42, a differential 44, a summer 46, and a pulse width modulator 48.

The throttle valve position signal from sensor 34 is transmitted to comparator 42 by a lead 50 and the accelerator pedal position signal from sensor 28 is transmitted to comparator 42 by a lead 52 so that a signal A representing the actual position of the throttle valve is constantly fed to comparator 42 by lead 50 and a signal D representing the desired position of the throttle valve as called for by accelerator pedal 15 is constantly transmitted to comparatòr 42 by lead 52. Comparator 42 functions in known manner to generate a difference or error signal A - D which is delivered to differential 44 by a lead 54 and to summer 46 by a lead 56.

Differential 44 receives error signal A-D and, in known manner, generate a differential signal (A-D) which is transmitted to summer 46 via line 58. Summer 46 also receives a signal A, representing the instantaneous position of the throttle valve 13, via lead 60 so that summer 46 is at all times receiving and processing an actual throttle signal A via lead 60, an error signal A-D via lead 56, and a differential signal A-D via lead 58. Summer 46 combines the three received signals to provide an output voltage signal A+-(A-D)+(A-D) which is fed via line 62 to pulse width modulator 48. The output signal of summer 46 is received by the control voltage input of the pulse width modulator 48 which delivers an output pulse width modulated signal to actuator 26 via a lead 64.

Actuator 26 preferably comprises a rotary proportional solenoid having its output shaft 26a drivingly and directly coupled to the other end 14b of pivot shaft 14 with the main body of the actuator mounted on the throttle body 11 in opposition to throttle valve position sensing means 22. Rotary proportional solenoid 26 may for example comprise a unit available from Ledex, Inc. of Vandalia, Ohio as Rotary Proportional Solenoid Part No. 187477-001.

The control system of the invention may also, where desired, include one or more weighting factors for controlling the magnitude of the signals A and D and the difference therebetween. Further details of the manner in which such weighting factors may be employed in the invention throttle control system, as well as further details of the construction and operation of a suitable pulse width modulator for use with the invention throttle control system, are disclosed in co-pending U.S. patent application Ser. No. 156,850 filed on Feb. 17, 1988 and assigned to the assignee of the present invention.

In the operation of the invention throttle control system of FIGS. 1-5, accelerator pedal position sensing means 20 functions to provide a continuous electrical signal which is proportional to the instantaneous angular position of accelerator pedal 15; throttle valve position sensing means 22 functions to provide a continuous electrical signal which is proportional to the instantaneous angular position of throttle valve 13; control module 24 functions to generate an output signal which is a composite of a throttle valve position signal, an error signal representing the difference between the throttle valve position signal and the accelerator pedal position signal, and a differential signal representing the differential with respect to time of the error signal; and solenoid 26 functions to positively and precisely position throttle valve 13 in response to the control signal received from control module 24.

The invention throttle control system will be seen to provide many important advantages as compared to the prior art throttle control systems. Since the invention system incorporates the rate of change of the error signal, the invention system follows the input voltage from the throttle pedal sensor at an extremely fast response rate. Further, the contact-less sensing means provided by the proximity sensors in combination with the target plates serve to provide reliable and accurate operation over sustained periods of use, thereby avoiding the usual and known problems plaguing contact type sensor devices. The invention also provides an accelerator pedal assembly which incorporates a control logic so that the accelerator pedal assembly, when installed in the vehicle, not only provides the usual accelerator pedal function but also functions to provide an electrical output signal for use in positioning the throttle valve of the associated vehicle. The invention also provides a modular assembly for the accelerator pedal and control logic which can be thoroughly pretested prior to delivery to the motor vehicle manufacturer, thereby improving overall vehicle quality control and lowering the vehicular warranty costs.

Figure 6:
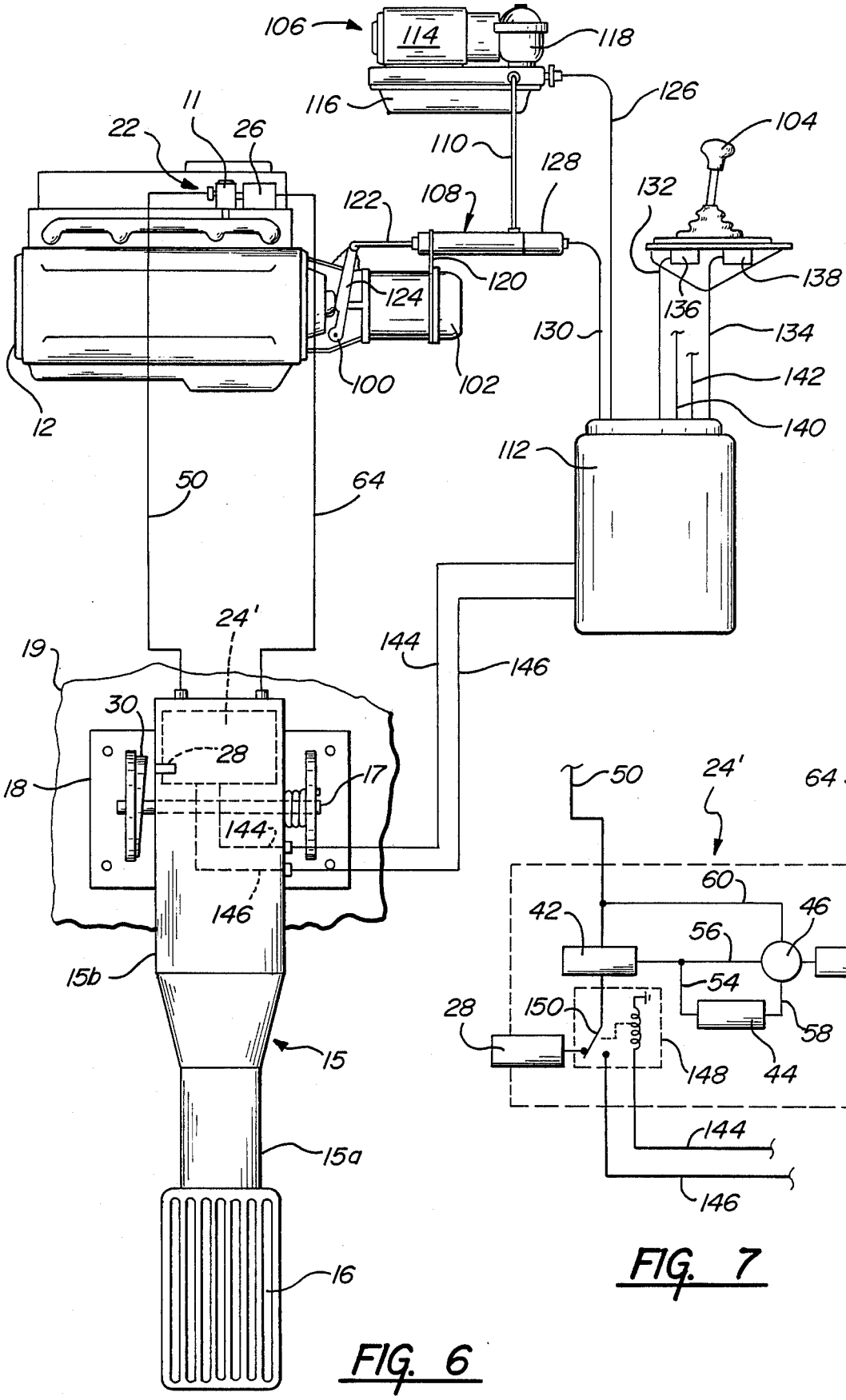
FIG. 6 is a somewhat schematic view of an automatic clutch and throttle control system embodying the throttle control system of the invention.
Figure 7:
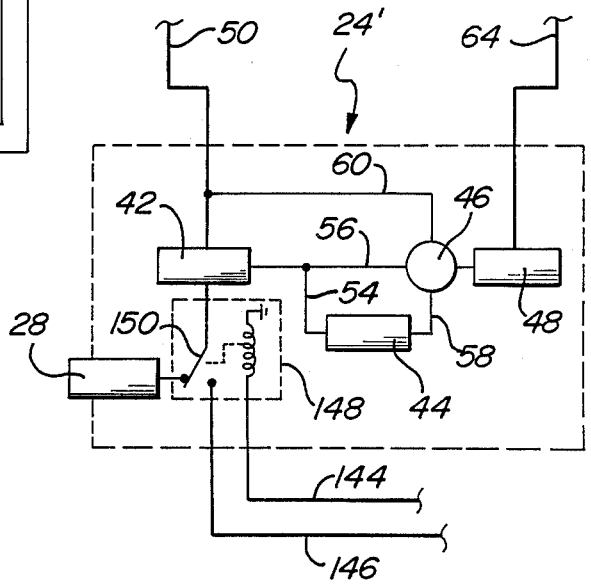
FIG. 7 is a detailed view of a logic module employed in the automatic clutch and throttle control system of FIG. 6.

The invention throttle control system is seen in FIG. 6 incorporated into an automatic clutch and throttle control system for a motor vehicle. The motor vehicle seen in FIG. 6, in addition to the firewall 19 and the engine 12, further includes a clutch 100, a gearbox 102, and a gearshift lever 104. The automatic clutch and throttle control system of FIG. 6, in addition to the throttle control system described with reference to FIGS. 1-5, includes a hydraulic control assembly 106, a slave cylinder 108, a hydraulic conduit 110 interconnecting hydraulic control assembly 106 to slave cylinder 108, and a control module 112.

Hydraulic control assembly 106 includes an electric motor 114, a reservoir 116, and an accumulator 118.

Slave cylinder 108 is of known form and is positioned externally of the housing of clutch 100 by a bracket 120 with the free end of the slave cylinder piston rod 122 connected to a clutch release lever 124 so as to engage and disengage the clutch in known manner upon reciprocal movement of slave cylinder piston rod 122.

Control module 112 embodies a control logic and is connected to hydraulic control assembly 106 by a lead 126: to a travel sensor 128 associated with slave cylinder 108 by a lead 130; to gearshift lever 104 by leads 132 and 134 associated with switches 136 and 138; to an engine speed sensor (not shown) but by a lead 140; to a gearbox input speed sensor (not shown) by a lead 142; and to control logic module 24' by leads 144 and 146.

Lead 144 controls a relay 148 embodied in control logic 24, and including a relay switch 150 movable between a first position connecting sensor 28 to comparator 42 and a second position in which sensor 28 is disconnected from comparator 42 and lead 146 from control module 112 is connected to comparator 42. Control logic 24' is otherwise identical to control module 24.

Hydraulic control assembly 106 includes an internal control system, under the control of control module 112, whereby motor 106 is operated intermittently to maintain a desired predetermined pressure of the hydraulic fluid in the accumulator 118 for delivery, upon receipt of an appropriate signal from control module 112, through conduit 110 to slave cylinder 108 for engagement or disengagement of the clutch through actuation of clutch release lever 124.

Switches 136 and 138 coact with gearshift lever 104 to transmit appropriate gearshift lever position signals through leads 132 and 134 to control module 112 so that the control module is at all time receiving an input signal through leads 132 and 134 representative of the position of gear lever 104. The control module is also at all times receiving an input signal through lead 130 indicating the linear position of the piston of the slave cylinder 108. In the operation of the automatic clutch and throttle control system of FIG. 6, throttle valve 13 remains under the control of the accelerator pedal 15 via sensor 28 until such time as the vehicle operator initiates a shifting operation via the gearshift lever 104. The control module 112 functions to remove control of the throttle valve 13 from the accelerator pedal as soon as it senses that the operator is initiating a gear change operation and retains control of the throttle valve via leads 146 until the gear change operation has been completed. Upon sensing initiation of the gear change operation, control module 112 appropriately signals the hydraulic control assembly 106 to actuate slave cylinder 108 in a sense to disengage the clutch and, following sensing of the completion of the gear shifting operation, the control module appropriately signals the hydraulic control assembly in a sense to allow retraction of the slave cylinder and reengagement of the clutch. Control module 112 further functions during the shifting operation to maintain the throttle valve in a desired position to enable a smooth and positive shifting operation.

Specifically, upon the initiation of a shifting operation, module 112 sends a signal via lead 144 to relay 148 to connect comparator 42 to lead 146 and disconnect sensor 28 so that module 112 may function via lead 146 to maintain the throttle valve in the desired position during the shifting operation. Following completion of the shifting operation, relay 148 is signaled by module 112 via lead 144 to move to a position reconnecting sensor 28 to comparator 42, whereby to return control of the throttle valve to the accelerator pedal.

Various parameters and programs may be incorporated into the logic of control module 112 to coordinate the engagement and reengagement of the clutch with the enablement and disablement of the throttle control system in a manner to ensure smooth, precise, and positive engagement and reengagement of the clutch. Examples of such parameters and programs are shown, for example, in U.S. Pat. Nos. 4,413,714, 4,418,810, 4,432,445, 4,497,397, 4,518,064 and 4,561,530, all assigned to the assignee of the present invention.

The throttle control system of the FIG. 8 embodiment relates only to the manner in which the accelerator pedal assembly functions to generate a control output signal for use in positioning the throttle valve. The sensing system employed in the embodiment of FIG. 8 to sense the instantaneous angular position of the accelerator pedal is generally similar to the system employed in the embodiment of FIGS. 1–5 with the exception that the target device is mounted for movement with the accelerator pedal and the proximity sensor and associated control module are fixedly mounted on the associated bracket.

Specifically, the throttle control system of FIG. 8 is illustrated as embodied in a motor vehicle control pedal assembly including a pedal box 70 secured to the vehicle firewall 19; a pedal shaft 72 journaled in the side flanges **70*a* and 70*b* of the pedal box; a clutch pedal assembly 74 pivoted to the left end of pivot shaft 72 outboard of pedal box flange portion 70*a*; a brake pedal assembly 76 pivoted to pivot shaft 72 intermediate pedal block flange portions 70*a* and 70*b*; and an accelerator pedal assembly 78 fixedly secured to the free, right-hand end 72*a* of pivot shaft 72 outboard of pedal box flange portion 70*b*. Accelerator pedal assembly 78 includes an accelerator pedal arm 80, secured at its upper end to a a sleeve 81 and a pedal pad 82 secured to the lower end of pedal arm 80. Sleeve 81 is journaled on end 72*a* of pivot shaft 72**.

A bracket 84 is secured to the outboard face of pedal box flange portion **70*b* by bolts 86. Bracket 84 defines a hollow central chamber 84*a* and includes an end wall 84*b* journaling sleeve 81. A target plate 88, generally similar to target plate 36 in the FIGS. 1–5 embodiment, is secured to sleeve 81 within chamber 84*a*. A Hall effect sensor 90 is also positioned within chamber 84*a* and is integrated with a control module 24 of the type disclosed in the FIGS. 1–5 embodiment. A socket 92 formed on bracket 84 is adapted to receive a plug carrying a lead from the associated throttle valve position sensing mechanism as well as a lead extending from the pulse width modulator of the control module 24 to the actuator for positioning the throttle valve. Target plate 88 defines an arcuate target surface for coaction with the confronting magnetic radiating face of sensor 90 and sensor 90 is positioned at a radial distance from the axis of shaft 72 corresponding to the mean radius of the arcuate target surface defined on target plate 88 so that, in the manner previously described with respect to the embodiment of FIGS. 1–5, sensor 90 continuously tracks the angular position of pedal arm 80 so as to continuously generate an electrical output signal that is proportional to the angular position of the pedal arm and that is delivered to the comparator of the control module 24** for comparison with the input signal representing the actual position of the throttle valve.

The assembly of FIG. 8 will be seen to provide a means of providing the total pedal assembly of a motor vehicle, including the clutch, brake and accelerator pedal assemblies, while simultaneously providing a position sensing device to track the instantaneous position of the accelerator as well as provide a control module to compare the signal representing the instantaneous position of the accelerator pedal with the instantaneous position of the throttle valve so as to generate a control signal for transmittal to the actuator controlling the throttle valve. As with the embodiment of FIGS. 1–5, the entire assembly can be thoroughly pretested prior to delivery to the vehicle manufacturer with consequent improvement in overall vehicle quality control and consequent lowering of vehicle warranty costs.

Whereas preferred embodiments of the invention have been illustrated and described in detail it will be apparent that various changes can be made in the disclosed embodiment without departing from the spirit or scope of the invention.

We claim:

1. In a motor vehicle throttle control system of the type including a throttle valve member position sensing means operative to generate a first electrical signal representing the position of the throttle valve member, accelerator member position sensing means operative to generate a second electrical signal representing the position of the accelerator member, control means receiving the first and second signals and operative to generate a control signal based on a comparison of the first and second signals, and actuator means receiving the control signal and operative to position the throttle valve control member in proportion to the control signal, the improvement wherein:

(A) at least one of said position sensing means comprises a sensor device and a target device; and (B) said sensor device and said target device are moved relative to each other in response to movement of the associated control member.

2. A throttle control system according to claim 1 wherein:

(C) said one position sensing means comprises said accelerator member position sensing means.

3. A throttle control system according to claim 1 wherein:

(C) said one position sensing means comprises said throttle valve member position sensing means.

4. A throttle control system according to claim 1 wherein:

(C) each of said position sensing means comprises a sensor and a target device movable relative to each other in response to movement of the associated control member.

5. A throttle control system according to claim 1 wherein:

(C) said associated control member is mounted for adjusting movement about a pivot axis; and (D) said target device presents an arcuate target surface to said position sensing device that is centered on said axis and that progressively varies in distance from said sensor device in response to pivotal adjusting movement of said associated control member about said axis.

6. A throttle control system according to claim 5 wherein:

(E) said one position sensing means comprises said accelerator member position sensing means.

7. A throttle control system according to claim 5 wherein:

(E) said one position sensing means comprises said throttle valve member position sensing means.

8. A throttle control system according to claim 5 wherein:

(E) each of said position sensing means includes a sensor and a target device.

9. A throttle control system according to wherein:

(E) said sensor is mounted on said control member and said target device is fixed.

10. A throttle control system according to claim 5 wherein:

(E) said target device is mounted on said control member and said sensor is fixed.

11. A throttle control system according to claim 5 wherein:

(E) said target surface has a spiral disposition relative to said axis.

12. A throttle control system according to claim 11 wherein:

(F) said sensor is operative to generate a voltage signal that varies in proportion to the distance of said sensor from said target surface.

13. A throttle control system according to claim 12 wherein:

(G) said sensor device is a Hall effect proximity sensor

14. A throttle control system according to claim 1 wherein:

(C) said control signal includes a first component representing the rate of change of the difference between said first and second signals and a second component representing the difference between said first and second signals.

15. A throttle control system according to claim 14 wherein:

(D) said control signal includes a third component representing said first electrical signal.

16. A throttle control system according to claim 14 wherein:

(D) said control means includes a comparator receiving said first and second electrical signals and generating an error signal representing the difference between said first and second signals and a differential receiving said error signal and generating a differential signal representing the rate of change of said error signal.

17. A throttle control system according to claim 16 wherein:

(E) said control means further includes a summer; and (F) said summer receives said first signal said error signal and said differential signal and generates a control signal having a first component representing said first signal, a second component representing said error signal and a third component representing said differential signal.

18. A throttle control system according to claim 14 wherein:

(D) said actuator means comprises a proportional solenoid.

19. A throttle control system according to claim 2 wherein:

(D) said system further includes a, bracket structure;

(E) said accelerator control member includes a pedal arm and a pedal pad on the lower end of said arm;

(F) the upper end of said arm is mounted for pivotal movement on said bracket structure about a pivot axis; and (G) one of said devices is mounted for pivotal movement with the upper end of said pedal arm and the other of said devices is mounted on said bracket structure.

20. A throttle control system according to claim 19 wherein:

(H) said target device is mounted on said bracket structure and said sensor device is mounted for pivotal movement with the upper end of said pedal arm.

21. A throttle control system according to claim 19 wherein:

(H) said sensor device is mounted on said bracket structure and said target device is mounted for pivotal movement with the upper end of said pedal arm.

22. A throttle control system according to claim 19 wherein:

(H) said target device defines an arcuate target area centered on said pivot axis and presenting a target surface to said sensor that progressively varies in distance from said proximity sensor device in response to pivotal movement of said pedal arm about said axis.

23. A throttle control system according to claim 22 wherein:

(I) said sensor device is mounted on the upper end of said pedal arm;

(J) said target device is mounted on said bracket structure; and (K) said control means comprises a logic circuit module mounted on the upper end of said pedal arm and receiving an output signal from said proximity sensor device and from said throttle valve member position sensing means.

24. A throttle control system according to claim 22 wherein:

(I) said target device is mounted for pivotal movement with said pedal arm;

(J) said sensor device is mounted on said bracket structure; and (K) said control means comprises a logic module mounted on said bracket structure.

25. A throttle control system according to claim 23 or claim 24 wherein:

(L) said target surface has a spiral disposition relative to said axis.

26. A control assembly comprising:

(A) a bracket member;

(B) an accelerator pedal assembly including a pedal arm member pivotally mounted adjacent its upper end on said bracket member and a pedal pad on the lower end of said pedal arm; and (C) a pedal position sensing means including a sensor device and a target device, one of said devices being mounted on said bracket member and the other of said devices being mounted for movement with said pedal arm member so that the devices undergo relative movement in response to pivotal movement of said pedal arm.

27. A control assembly according to claim 26 wherein:

(D) said target device defines an arcuate target area centered on the pivotal axis of said pedal arm member and presenting a target surface to said sensor device that progressively varies in distance from said sensor device in response to pivotal movement of said pedal arm member on said bracket so that the output signal of said sensor device varies in response to pivotal movement of said pedal arm member.

28. A control assembly according to claim 27 wherein:

(E) said control assembly is adapted for use with a throttle valve position sensing means;

(F) said control assembly further includes a logic module receiving the output signal from said position sensing device and from the throttle valve position sensing means and operative to generate a control signal as a function of the receive signals; and (G) said logic module is mounted on the member mounting said proximity sensor device.

29. A control assembly according to claim 28 wherein:

(H) said sensor device and said logic module are mounted on said pedal arm member and said target device is mounted on said bracket member.

30. A control assembly according to claim 28 wherein:

(H) said sensor device and said logic module are mounted on said bracket and said target device is mounted for movement with said pedal arm member.

31. A control assembly according to claim 29 or 30 wherein:

(I) said target device presents an arcuate target surface to said sensor device that is centered on the pivot axis of said pedal arm member and that varies in distance from said sensor device in response to pivotal movement of said pedal arm member.

32. A control assembly according to claim 31 wherein:

(J) said target surface has a spiral disposition relative to said pivot axis.

33. A throttle and clutch control system for use with a motor vehicle of the type including an engine, a transmission, a gearshift lever, a clutch interposed between the engine and the transmission, and a throttle body including a throttle valve, said control system including:

(A) throttle valve position sensing means operative to generate a first electrical signal representing the position of the throttle valve;

(B) an accelerator pedal assembly including an accelerator pedal, accelerator pedal position sensing means operative to generate a second electrical signal representing the position of the accelerator pedal, and a control module positioned proximate said accelerator pedal and operative to generate a control signal based on a comparison of said first and second signals;

(C) actuator means receiving the control signal and operative to position the throttle valve in proportion to said control signal; and (D) control means operative in response to movement of the gear shift lever to disengage the clutch, disconnect said second electrical signal from said control module, and transmit a third electrical signal to said control module so that said control signal is based on a comparison of said first and third electrical signals, and thereafter, following completion of the shifting movement of the gear shift lever, reengage the clutch and reconnect said second electrical signal to said control module.

34. A throttle and clutch control system according to claim 33 wherein:

(E) at least one of said position sensing means comprises a sensor device and a target device; and (F) said sensor device and said target device are moved relative to each other in response to movement of the associated control member.

35. A throttle and clutch control system according to claim 34 wherein:

(G) said one position sensing means comprises said accelerator member position sensing means.

36. A throttle and clutch control system according to claim 33 wherein:

(E) said control signal includes a first component representing the rate of change of the difference between said first and second signals and a second component representing the difference between said first and second signals.

37. A throttle and clutch control system according to claim 36 wherein:

(F) said control signal includes a third component representating said first electrical signal.

38. A throttle and clutch control system according to claim 33 wherein:

(E) said control module is mounted on said accelerator.

39. A throttle and clutch control system according to claim 33 wherein:

(E) accelerator pedal assembly further includes a bracket pivotally mounting said accelerator pedal and said control module is mounted on said bracket.

* * * * *

UNITED STATES PATENT AND TRADEMARK OFFICE

CERTIFICATE OF CORRECTION

PATENT NO. : 4,883,037

DATED : November 28, 1989

INVENTOR(S) : Mabee, et al

It is certified that error appears in the above-identified patent and that said Letters Patent is hereby corrected as shown below:

Column 4, line 12, delete "I1" and insert --11--.

Column 7, line 17, delete "time" and insert --times--.

Column 9, line 58, after "according to" insert --claim 5--.

Column 14, line 5, after "E)" insert --said--.

Signed and Sealed this

Tenth Day of September, 1991

*Attest:*

HARRY F. MANBECK, JR.

*Attesting Officer*

*Commissioner of Patents and Trademarks*